US006854665B1

(12) United States Patent
Di Gioia et al.

(10) Patent No.: US 6,854,665 B1
(45) Date of Patent: Feb. 15, 2005

(54) SYSTEM FOR SPRAYING A POWDER COATING PRODUCT AND SPRAYHEAD INCORPORATED IN IT

(75) Inventors: Michel Di Gioia, Seyssinet Pariset (FR); Jose Rodrigues, Saint Guillaume (FR)

(73) Assignee: Sames S.A., Meylan (FR)

( * ) Notice: Subject to any disclaimer, the term of this patent is extended or adjusted under 35 U.S.C. 154(b) by 242 days.

(21) Appl. No.: 09/536,341

(22) Filed: Mar. 25, 2000

(30) Foreign Application Priority Data

Mar. 25, 1999 (FR) ..... 99 03743

(51) Int. Cl.[7] ..... B05B 3/10

(52) U.S. Cl. ..... 239/223; 239/224; 239/700; 239/706

(58) Field of Search ..... 239/214, 223, 239/224, 690, 700, 703, 704, 706

(56) References Cited

U.S. PATENT DOCUMENTS 581,206 A * 4/1897 Hewitt ..... 261/89
1,620,625 A * 3/1927 Babka ..... 239/223
1,870,099 A * 8/1932 Croan ..... 239/223
3,061,200 A * 10/1962 Ficker ..... 239/224 X
3,233,580 A * 2/1966 Levake ..... 239/223 X
4,838,487 A * 6/1989 Schneider ..... 239/223
5,353,995 A * 10/1994 Chabert ..... 239/703 X
5,894,993 A * 4/1999 Takayama et al. ..... 239/223 X

FOREIGN PATENT DOCUMENTS

DE 271 654 A1 6/1997
EP 0 870 546 A2 10/1998

* cited by examiner

*Primary Examiner*—Robin O. Evans
(74) *Attorney, Agent, or Firm*—Wallenstein Wagner & Rockey, Ltd.

(57) ABSTRACT

A system for spraying a powder coating product includes a rotary sprayhead which is preferably of the type which is electrostatically charged. The sprayhead has a rotary part which can be driven in rotation. A narrow flow space in the sprayhead in the form of a flat ring incorporates a flow chicane forming an impact surface on the path of the coating product.

7 Claims, 1 Drawing Sheet

SYSTEM FOR SPRAYING A POWDER COATING PRODUCT AND SPRAYHEAD INCORPORATED IN IT

RELATED APPLICATIONS

This application claims priority to French Patent Application No. 9903743 filed Mar. 25, 1999.

BACKGROUND OF THE INVENTION

1. Field of the Invention

The invention relates to a system for spraying a powder coating product, in particular an electrostatic spraying system for coating objects with a powder material, for example a thermofusible powder paint.

The invention relates more particularly to an improvement seeking to eliminate lumps of powder that can form and be entrained in the flow of air-powder mixture.

The invention also relates to a rotary powder sprayhead which preferably includes ionizing means for electrically charging the powder sprayed toward the item to be coated.

2. Description of the Prior Art

To guarantee a high deposition efficiency in the application of a powder coating product, such as a thermofusible product, to an object to be coated, it is necessary for the powder sprayed toward the object to be electrically charged, the object being at least weakly electrically conductive and grounded. The powder particles can be charged by a triboelectric effect but it is more usual to employ electrostatic charging means constituted by one or more electrodes situated in the vicinity of the air-powder mixture ejection orifice. A high voltage is applied to the electrode to charge the powder particles.

Some prior art systems use a sprayhead in the form of a bowl or disk having at least one rotary part which can be driven in rotation at a relatively high speed, for example by a pneumatic turbine. An annular space in which the air-powder mixture flows is defined inside the sprayhead, which causes the air-powder mixture to rotate and communicates to the powder particles centrifugal energy which creates a cloud of powder ejected toward the object. A ring of air ejector orifices all around the rear of the sprayhead directs the cloud of powder in the forward direction, i.e. toward the object to be coated. The ionizing electrode is generally combined with the rotary sprayhead. For example, it can be a metal disk forming the front face of the sprayhead with the edge of the disk in the immediate vicinity of the annular air-powder mixture ejection orifice defined at the periphery of the sprayhead. The latter incorporates an axial cavity in which an air-powder mixture feed pipe terminates.

A system of the above kind is generally satisfactory in operation, but under some unfavorable operating conditions lumps of powder are ejected and deposited on the part to be coated. After curing, these lumps cause appearance defects which necessitate reworking of the part. This reworking is difficult and costly.

There are essentially two kinds of lumps. One kind has no particular shape and consists of specks made up of powder granules. These specks can form under some unfavorable hygrometric conditions. They can be caused by the onset of polymerization of the powder due to heating. They are likely to be found in great numbers if the powder that is not deposited on the objects to be coated is recycled. Other lumps have a more specific shape. They are small flat lumps of powder and are usually referred to by the person skilled in the art as "eggshells". Their formation is attributed to deposits of powder on the walls of the pipes in which the air-powder mixture flows. These deposits separate and break up from time to time, giving rise to the "eggshells".

In-depth studies have identified the key points in a powder spraying installation that can influence the formation of lumps of powder in general and "eggshells" in particular.

Thus it has been shown that there is a relationship between the diameter of the air-powder mixture pipes and the rate of formation of the "eggshells". Other things being equal, it is preferable to use small diameter pipes to reduce this rate. It has also been shown that it is preferable to fluidize the powder in the storage tank for some time before beginning to spray the powder. Thus ventilating the storage tank for 24 hours before use significantly reduces the proportion of "eggshells". Finally, careful grounding of the storage tank also has a significant influence on the proportion of "eggshells".

In all cases it is obviously advantageous to minimize the length of the pipes in which the air-powder mixture flows.

Although the above precautions reduce the rate of production of lumps, and more particularly of "eggshells", it has been shown that completely preventing them from being formed is not possible. This is why the basic idea of the invention is to destroy such lumps in the air-powder mixture before it is ejected toward the part to be coated, more particularly in the sprayhead including a rotating part which can be driven in rotation, exploiting the centrifugal force applied to the air-powder mixture in the narrow flow space in the sprayhead.

SUMMARY OF THE INVENTION

The invention provides a system for spraying a powder coating product to coat objects, the system including a sprayhead and an air-powder mixture feed pipe having an outlet discharging axially into the sprayhead, which is in the form of a bowl or disk having a circular ejection edge at its periphery, at least one rotating part adapted to be driven in rotation and a narrow flow space between the outlet of the feed pipe and a circular ejection edge at the periphery of the sprayhead, which flow space includes at least one flow chicane forming an impact surface on the path of the coating product.

In the usual situation in which the sprayhead includes a cup surrounding the end of the feed pipe and a deflector facing the outlet of the feed pipe and the cup, and the flow space is between facing faces of the cup and the deflector, the chicane can include at least one annular rib and at least one annular groove on respective facing faces of the cup and the deflector and which are partly interleaved in the axial direction.

The invention also provides a sprayhead for use in a system for spraying a powder coating product, which sprayhead includes a bowl or disk having at least one part adapted to be driven in rotation, an axial cavity adapted to accommodate an air-powder mixture feed pipe, a circular ejection edge at its periphery and a narrow flow space between the cavity and the circular ejection edge, which flow space includes at least one flow chicane forming an impact surface.

The invention will be better understood and other advantages of the invention will become more clearly apparent in the course of the following description, which is given by way of example only and with reference to the accompanying drawing.

BRIEF DESCRIPTION OF THE DRAWING

The single FIGURE of the accompanying drawing is a part-sectional perspective view of part of a system in accordance with the invention for spraying a powder coating product.

DETAILED DESCRIPTION OF THE PREFERRED EMBODIMENT

Figure 1:
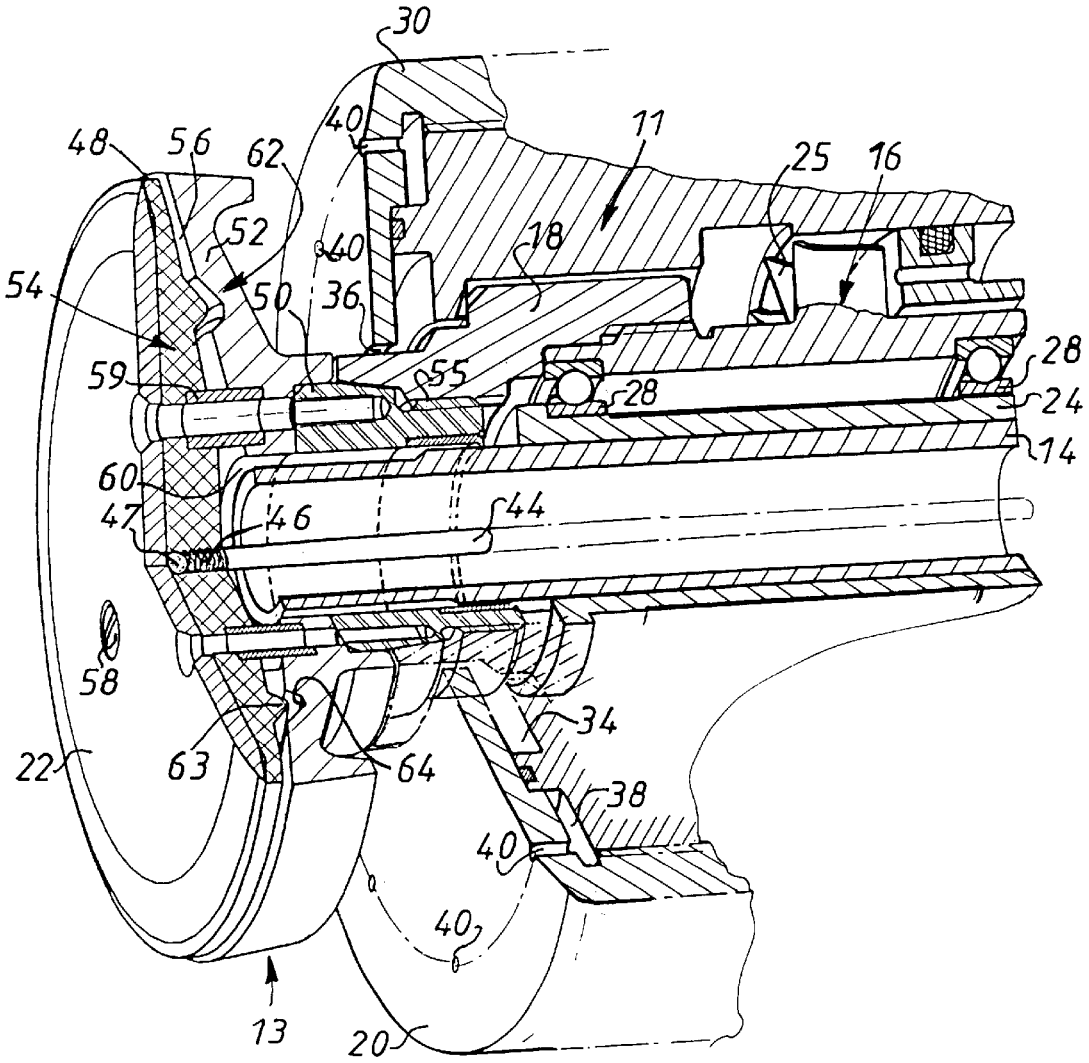

The powder coating product spraying system shown is essentially made up of a globally cylindrical casing 11 and a sprayhead 13 in the global form of a bowl or disk rotatably mounted at the end of the casing. The latter has an axial opening accommodating an air-powder mixture feed pipe 14 and a pneumatic turbine 16 around the pipe. The output shaft 18 of the turbine is in the form of a sleeve and projects beyond the front face 20 of the casing. It carries the rotary sprayhead 13. The latter forms or includes an electrode 22 forming part of ionizing means connected to a high-voltage supply, the electrical connection passing along the interior of the feed pipe 14, as explained below. The feed pipe 14 is a rigid pipe attached to the casing and communicating with a flexible hose, not shown. The rigid pipe extends axially inside a sleeve 24 forming the support of the pneumatic turbine. The sleeve is fixed and is fastened to the other fixed components of the casing. The rotor of the turbine 16, carrying blades 25, is mounted to rotate on the sleeve 24 on two axially spaced ball bearings 28. At the front of the casing, which is closed by a cap 30 screwed onto an external screwthread on the body of the casing, are annular chambers fed with compressed air. One annular chamber 34 is near the shaft 18 and receives the air for driving the turbine 16. This air exhausts via an annular clearance 36 between the cap and the shaft, assuring continuous cleaning of the latter. Another annular chamber 38 feeds air ejector passages 40 whose orifices are on a circle on the front face of the cap, concentric with the rotation axis of the sprayhead 13, and whose diameter is close to the outside diameter of the latter. These passages are directed toward the periphery of the sprayhead to create a flow of air entraining the air-powder mixture toward the object to be coated. An annular cylindrical counter-electrode, not visible in the drawing, is housed in a cavity of the casing. It is axially set back relative to the sprayhead. It is electrically grounded, preferably via a high value resistor. Most of the component parts of the casing are made from insulative materials. Likewise the sprayhead, except for its front face which carries the metal electrode 22 which is in the form of a disk and can be connected to a high voltage. The high voltage is applied to the electrode via a metal rod 44 passing axially through the feed pipe 14. The end of the rod is inserted into an axial hole in the sprayhead which houses a spring 46 and a ball 47 in electrical contact with the rear face of the electrode 22, at its center.

The electrode 22 has a sharp edge near the periphery of the sprayhead 13. An ionizing field is therefore created between the electrode and the set back counter-electrode, charging the particles of the air-powder mixture ejected from the annular outlet 48 of the sprayhead.

The sprayhead includes a globally tubular hub 50, a cup 52 fixed to the front end of the hub, coaxially with it, and a deflector 54. The hub 50 has an external screwthread 55 by means of which it is screwed into a threaded part of the hollow shaft 18 of the turbine 16. The hub 50 and the cup 52 surround the end of the feed pipe 14. The deflector 54 is opposite the cup 52 and the orifice of the feed pipe. There is therefore a narrow flow space 56 between the facing faces of said cup and said deflector. The general configuration of the flow space is a thin slightly conical flat circular annular ring. Its section preferably decreases in the radially outward direction. The hub 50, the cup 52 and the deflector 54 are fastened together by three screws 58 passing through hollow spacers 59 between the cup 52 and the deflector 54, the length of these spacers determining the section of the flow space. Except for the electrode 22, the components of the sprayhead are made from insulative materials. The sprayhead proper (i.e. regarded as a separate part which can be replaced) therefore has an axial cavity 60 which is delimited by the hub 50, the central hole in the cup 52 and the central part of the rear face of the deflector 54 and which accommodates the end of the air-powder mixture feed pipe 14, which is fastened to the casing. Said flow space 56 extends between the cavity 60 and a circular ejection edge at its periphery. The ejection outlet 48 of the air-powder mixture is therefore a continuous circular slot.

Alternatively, only one of the two components of the sprayhead (i.e. either the cup or the deflector) is rotatable, the other being fastened to the casing.

The spraying system described until now is of a type known in the art. One example of a system of this kind is described in French patent 2 692 173 in particular.

In accordance with a characteristic feature of the invention, the flow space 56 includes at least one flow chicane 62 forming an impact surface on the path of the coating product. The lumps of powder entrained by centrifugal force, which are heavier, are therefore broken up on this annular discontinuity.

The chicane is formed in the flow space by an annular rib 63 and an annular groove 64 on facing faces of the cup and the deflector, respectively. The rib and the groove are partially interleaved in the axial direction.

In the example shown, the rib 63 projects from the rear face of the deflector and the groove 64 is in the cup 52.

The chicane can of course include several sets of grooves and ribs. In the example, the chicane is approximately half way along the path of the air-powder mixture in the flow space 56. It is in theory desirable for it to be located as far as possible in the radially outward direction, so that it does not limit unacceptably the flowrate of the air-powder mixture.

By virtue of this configuration of the flow space, lumps of powder, and in particular those referred to as "eggshells", are destroyed when they are propelled into the flow space 56, where their speed is increased by the effect of centrifugal force.

What is claimed is:

1. A system for spraying a powder coating product to coat objects, said system including a sprayhead and an air-powder mixture feed pipe having an outlet discharging axially into said sprayhead, which is in the form of a bowl or disk having a circular ejection edge at its periphery, at least one rotating part adapted to be driven in rotation and a narrow flow space between said outlet of said feed pipe and said circular ejection edge at the periphery of said sprayhead, which flow space includes at least one flow chicane forming an impact surface on the path of said coating product.

2. The system claimed in claim 1 wherein said sprayhead includes a cup surrounding the end of said feed pipe and a deflector facing said outlet of said feed pipe and said cup, said flow space is between facing faces of said cup and said deflector and said chicane includes at least one annular rib and at least one annular groove on respective facing faces of said cup and said deflector and which are partly interleaved in the axial direction.

3. The system claimed in claim 2 wherein said rib is on said deflector and said groove is in said cup.

4. The system claimed in claim 1 wherein said sprayhead forms or includes ionizing means.

5. A sprayhead for use in a system for spraying a powder coating product, said sprayhead comprising a bowl or disk having at least one part adapted to be driven in rotation, an axial cavity adapted to accommodate an air-powder mixture feed pipe, a circular ejection edge at its periphery and a narrow flow space between said cavity and said circular ejection edge, said flow space includes at least one flow chicane forming an impact surface.

6. A sprayhead as claimed in claim 5 including a cup in which said axial cavity is formed and a deflector facing said cup and forming part of a wall of said cavity, wherein said narrow flow space is between facing faces of said cup and said deflector and said chicane includes at least one annular rib and at least one annular groove on respective facing faces of said cup and said deflector and partly interleaved in the axial direction.

7. The sprayhead claimed in claim 6 wherein said rib is on said deflector and said groove is in said cup.

* * * * *